United States Patent [19]

Hoff et al.

[11] Patent Number: 5,044,190

[45] Date of Patent: Sep. 3, 1991

[54] BASE FOR ROTATABLY SUPPORTING A COLLET CRIMPING MACHINE

[75] Inventors: Steven R. Hoff, Ft. Wayne, Ind.; Richard I. Wermer, Hicksville, Ohio

[73] Assignee: Dana Corporation, Toledo, Ohio

[21] Appl. No.: 578,077

[22] Filed: Sep. 4, 1990

[51] Int. Cl.[5] ..... B21D 41/04

[52] U.S. Cl. ..... 72/402; 72/447; 72/455; 29/237; 100/231

[58] Field of Search ..... 72/402, 447, 455, 456, 72/462, 482, 481; 29/237, 753, 761; 100/231, 214

[56] References Cited

U.S. PATENT DOCUMENTS

| | | | |
|---|---|---|---|
| 130,878 | 8/1872 | Stiles | 100/231 |
| 2,141,657 | 12/1938 | Meier | 72/447 |
| 2,202,125 | 5/1940 | Temple | 72/415 |
| 2,572,949 | 10/1951 | Reese | 100/231 |
| 2,602,508 | 7/1952 | Patrick | 100/231 |
| 3,731,518 | 5/1973 | Blochner | 72/402 |
| 3,750,452 | 8/1973 | Frank | 72/402 |
| 4,007,679 | 2/1977 | Edwards | 100/231 |
| 4,250,607 | 2/1981 | Lillbacka et al. | 72/402 |
| 4,285,228 | 8/1981 | Gunning | 72/402 |
| 4,309,892 | 1/1982 | Currie | 29/237 |
| 4,434,978 | 3/1984 | Kloster | 269/69 |
| 4,485,664 | 12/1984 | Richards | 72/389 |
| 4,625,539 | 2/1986 | Brooks et al. | 72/402 |
| 4,866,973 | 9/1989 | Hoff | 72/402 |

FOREIGN PATENT DOCUMENTS

| | | | |
|---|---|---|---|
| 487426 | 10/1952 | Canada | 72/456 |
| 363919 | 11/1922 | Fed. Rep. of Germany | 72/447 |
| 2434683 | 2/1975 | Fed. Rep. of Germany | 72/402 |
| 142012 | 6/1980 | German Democratic Rep. | 72/237 |
| 5023 | of 1878 | United Kingdom | 72/456 |

*Primary Examiner*—Daniel C. Crane

*Attorney, Agent, or Firm*—MacMillan, Sobanski & Todd

[57] ABSTRACT

A mounting structure for a collet crimping machine is disclosed which permits the machine to be selectively rotated between vertical and horizontal positions as desired for use. A pair of upstanding support arms have respective brackets rotatably mounted thereon which are connected to the collet crimping machine. A retaining device is provided for selectively retaining the collet crimping machine in a desired rotational position relative to the mounting base. In a first embodiment, the retaining device includes a spring loaded detent pin mounted on one of the support arms. The detent pin cooperates with a plurality of apertures formed through a portion of the bracket mounted on that arm for retaining the bracket (and the collet crimping machine connected thereto) in one of a plurality of discrete positions defined by the apertures. In a second embodiment, the retaining device includes a frictional gripping arrangement for retaining the bracket in any one of an infinite number of positions relative to the support arms.

9 Claims, 3 Drawing Sheets

BASE FOR ROTATABLY SUPPORTING A COLLET CRIMPING MACHINE

BACKGROUND OF THE INVENTION

This invention relates in general to collet crimping machines and in particular to a base for rotatably supporting a collet crimping machine which permits the machine to be selectively moved between horizontal and vertical positions for use.

The collet crimping machine is a well known device which is principally used for attaching a tubular end portion of a metallic fitting to the end of a high pressure hydraulic hose. To accomplish this, the end portion of the fitting is initially formed having an inner diameter which is larger than the outer diameter of the hose, permitting the end of the hose to be loosely inserted therein. Then, the end of the hose and the fitting are inserted within a die assembly of the collet crimping machine. The die assembly includes a collet which is contracted, by means of a hydraulically actuated mechanism on the collet crimping machine, so as to permanently deform or crimp the tubular end portion of the fitting about the end of the hose.

In the past, collet crimping machines have been fixedly mounted for use in a generally vertical position. When mounted in such a position, the end of the hose and the fitting are inserted vertically upwardly through the bottom of the machine to position them within the die assembly for the crimping operation. The vertical orientation of the machine facilitates the insertion and removal of different die assemblies from the machine, as is often necessary for crimping different sizes and shapes of fittings and hoses, by making them easily reachable by an operator of the machine. Additionally, the force of gravity tends to maintain the components of the die assembly in a desired orientation for use.

Unfortunately, a vertically oriented collet crimping machine may be difficult to use when attempting to attach a fitting onto the end of a long length of relatively inflexible hose. If the length of the hose is greater than the distance separating the bottom of the machine from the floor upon which it is used, an inflexible hose will resist being bent to permit the vertical insertion described above within the machine. To solve this problem, collet crimping machines have been fixedly mounted for use in a generally horizontal position. In such machines, the end of the hose and the fitting are inserted horizontally through the bottom of the machine to position them for the crimping operation. Although such machines are readily usable with hoses of virtually any length, it is awkward for the operator of the machine to insert and remove different die assemblies from the machine. Also, the individual components of the die assembly can be misaligned from their desired orientation because the force of gravity does not tend to maintain them in that orientation.

U.S. Pat. No. 4,866,973, owned by the assignee of this invention, discloses a mounting structure for a collet crimping machine which permits the machine to be selectively pivoted between vertical and horizontal positions as desired for use. A pivotable mounting bracket is provided including a flat base plate having a pair of upstanding brackets secured thereto. An arm is pivotably connected to each of the brackets. The ends of the arms are connected to the bottom of the collet crimping machine. Consequently, the machine may be pivoted between vertical and horizontal positions. Unfortunately, this structure has been found to be somewhat awkward to use because it is top heavy. The machine tends to fall too rapidly when it is pivoted from the vertical position to the horizontal position, and it is too heavy to lift comfortably when it is pivoted from the horizontal position to the vertical position. Thus, it would be desirable to provide an improved structure which is easier to use.

SUMMARY OF THE INVENTION

This invention relates to an improved base for rotatably supporting a collet crimping machine which permits the machine to be selectively moved between horizontal and vertical positions for use. The base includes a pair of upstanding support arms having respective brackets rotatably mounted thereon. The brackets are connected to the collet crimping machine such that the machine is rotatably supported on the support arms. Means are provided for selectively retaining the collet crimping machine in a desired rotational position relative to the mounting base. In a first embodiment of this invention, such retaining means includes a spring loaded detent pin mounted on one of the support arms. The detent pin cooperates with a plurality of apertures formed through a portion of the bracket mounted on that support arm for retaining the bracket (and the collet crimping machine connected thereto) in one of a plurality of discrete positions defined by the apertures. In a second embodiment of this invention, the retaining means includes a frictional gripping arrangement for retaining the bracket in any one of an infinite number of positions.

It is an object of this invention to provide an improved base for rotatably supporting a collet crimping machine which permits the machine to be selectively moved between horizontal and vertical positions for use.

It is another object of the present invention to provide such a base for a collet crimping machine which is simple and inexpensive in construction and operation.

Other objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
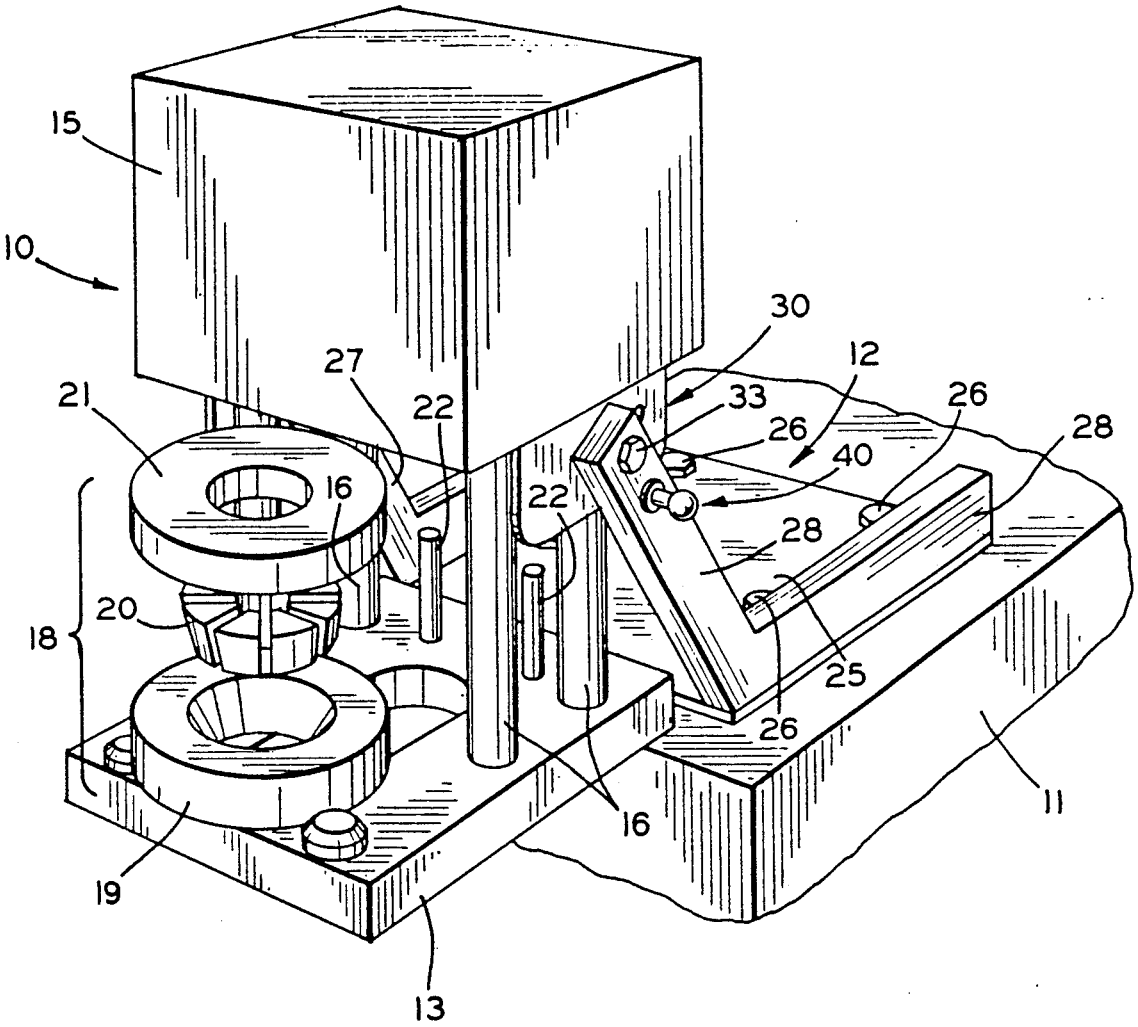
FIG. 1 is a perspective view of a collet crimping machine mounted on a rotatable base in accordance with the present invention, the collet crimping machine being disposed in the vertical position.

Referring now to the drawings, there is illustrated in FIG. 1 a collet crimping machine, indicated generally at 10, mounted on a support surface 11 by means of a rotatable mounting base, indicated generally at 12. The collet crimping machine 10 is conventional in the art and, for example, may be formed having the structure described and illustrated in U.S. Pat. No. 3,750,452, owned by the assignee of the present invention. The disclosure of that patent is incorporated herein by reference. Briefly, however, the collet crimping machine 10 includes a lower bed frame plate 13, an upper frame housing 15, and a set of columns 16. The columns 16 support the upper frame housing 15 above the bed frame plate 13. A ram (not shown) is reciprocably carried by the upper frame housing 15 for selective movement toward and away from the bed frame plate 13.

A die assembly 18, including a die ring 19, a collet assembly 20, and a spacer ring 21, are disposed between the bed frame plate 13 and the upper frame housing 15. A pair of stop pins 22 are connected to the rear portion of the bed frame plate 13 and extend upwardly therefrom. The stop pins 22 provide a positive locating means for positioning the die assembly 18 beneath the ram. As is well known in the art, when the die assembly 18 is properly positioned within the collet crimping machine 10, an end of a hose having a tubular metallic fitting (neither shown) may be inserted therein through a slot 23 formed through the bed frame plate 13. The ram is then actuated to move downwardly into engagement with the die assembly 18 so as to cause the collet assembly 20 to crimp the fitting onto the end of the hose.

The mounting base 12 includes a base plate 25 having a plurality of apertures (not shown) formed therethrough. Respective threaded fasteners 26 extend through the apertures to secure the base 25 to the support surface 11. First and second angled support arms 27 and 28 are provided on opposite sides of the base plate 25. The support arms 27 and 28 can be formed from hollow rectangular steel stock. Each of the support arms 27 and 28 includes a lower portion, which extends flat along the side of the base plate 25, and an upper portion, which extends upwardly therefrom. The lower portions of the support arms 27 and 28 are secured to the base plate 25, such as by welding, to form an integral support unit for the collet crimping machine 10. The upper portions of the support arms 27 and 28 are oriented at an angle of approximately 60° relative to the lower portions.

An L-shaped bracket, indicated generally at 30, is rotatably mounted on the upper end of each of the upper portions of the support arms 27 and 28. Each of the brackets 30 includes a horizontally extending portion **30*a* and a vertically extending portion 30*b*. The horizontally extending portions 30*a* have apertures (not shown) formed therethrough to accommodate threaded fasteners (not shown) which secure the brackets 30 to the upper frame housing 15 of the collet crimping machine 10. As will be explained in greater detail below, the vertically extending portions 30*b* are rotatably mounted on the upper end of each of the upper portions of the support arms 27 and 28 such that the collet crimping machine 10 may be rotated from the vertically disposed position illustrated in FIG. 1** to a horizontally disposed position, as well as to intermediate positions therebetween.

Figure 2:
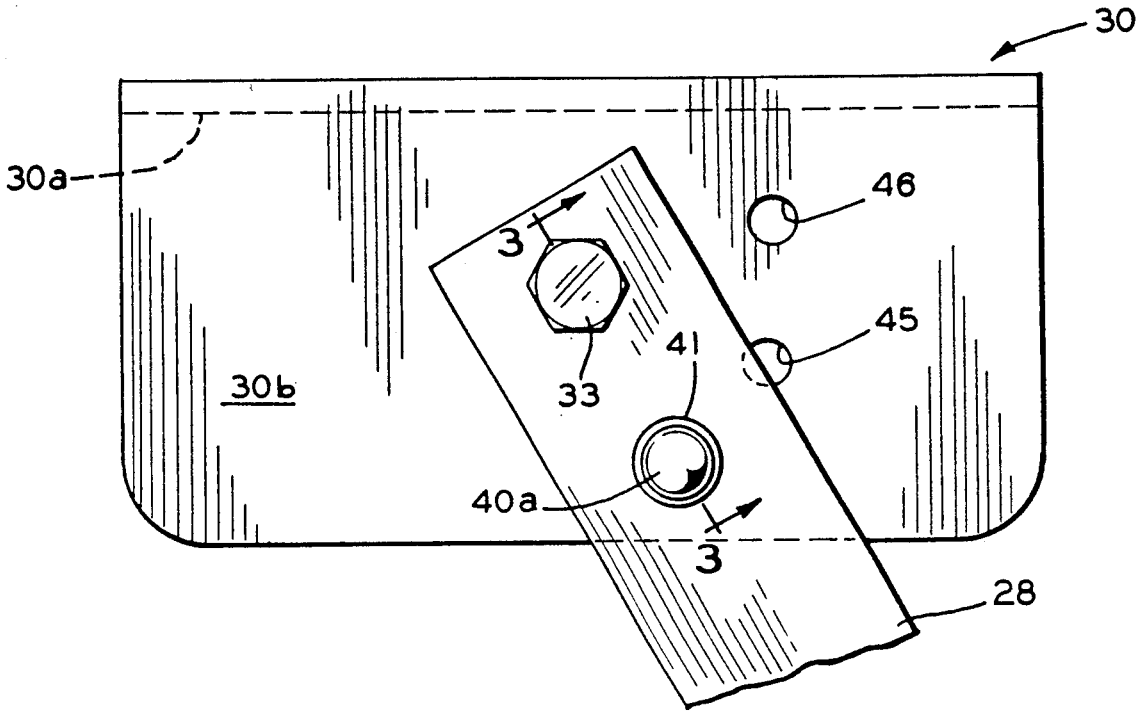
FIG. 2 is an enlarged side elevational view of the rotatable connection between one arm and one bracket of the base shown in FIG. 1.
Figure 3:
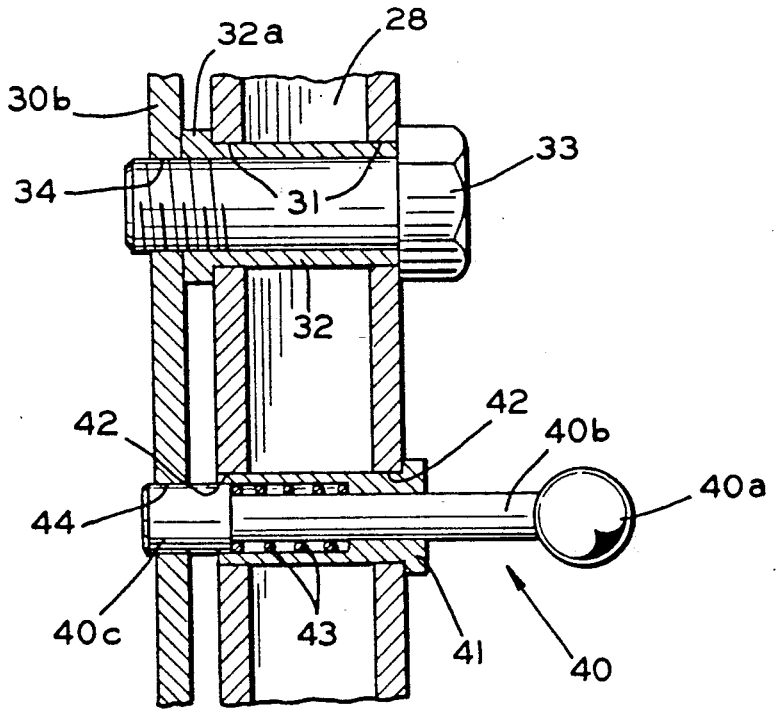
FIG. 3 is a sectional elevational view taken along line 3—3 of FIG. 2.

Referring now to FIGS. 2 and 3, the specific structure for rotatably mounting the bracket 30 to the upper end of the support arm 28 is illustrated in detail. As shown therein, a pair of aligned apertures 31 are formed through the sides of the support arm 28. A bushing 32 is pressed into and retained in such apertures 31. The bushing 32 has an enlarged head portion **32*a* which is disposed adjacent to the inner side of the support arm 28, i.e., the side of the support arm 28 which is adjacent to the vertically extending portion 30*b* of the bracket 30. A threaded fastener 33 extends through the bushing 32 and the support arm apertures 31 into threaded engagement with a threaded aperture 34 formed in the vertically extending portion 30*b* of the bracket 30. The threaded fastener 33 supports the bracket 30 (and, thus, the collet crimping machine 10) on the support arm 28. The bushing 32 supports the threaded fastener 33 therein for relative rotation. A similar rotatable mounting structure (not shown) is provided on the upper end of the other support arm 27**.

Thus, it can be seen that the collet crimping machine 10 is supported on the support arms 27 and 28 for rotation about an axis which extends through the aligned threaded fasteners 33. This axis of rotation is preferably co-axial with the horizontal center of gravity of the collet crimping machine 10. As a result, the collet crimping machine 10 rotates easily between its vertical and horizontal disposed positions. The co-axial alignment of the axis of rotation with the horizontal center of gravity of the collet crimping machine 10 can be achieved by determining the horizontal center of gravity of the machine 10 in any conventional manner and then forming the apertures 34 in appropriate locations on the brackets 30.

Means are provided for selectively retaining the collet crimping machine 10 in a desired rotational position relative to the mounting base 12. In the embodiment illustrated in FIGS. 2 and 3, this retaining means includes a detent pin, indicated generally at 40. The detent pin 40 includes an enlarged head portion **40*a*, a relatively small diameter shank portion 40*b*, and a relatively large diameter tail portion 40*c*. The detent pin 40 is slidably disposed in a bushing 41, which is pressed into a pair of aligned apertures 42 formed through the sides of the support arm 28. The bushing 41 includes a smaller inside diameter portion, in which the shank portion 40*b* is disposed, and a larger inside diameter portion, in which the tail portion 40*c* is disposed. A spring 43 is disposed about the shank portion 40*b* in the larger inside diameter portion of the bushing 41. The spring 43 reacts between the bushing 41 and the tail portion 40*c* to urge the detent pin 40 toward the vertically extending portion 30*b* of the bracket 30 rotatably supported on the support arm 30**.

A plurality of apertures 44, 45, and 46 are formed through the vertically extending portion **30*b* of the bracket 30. Such apertures 44 through 46 are located so as to be alignable with the tail portion 40*c* of the detent pin 40 when the bracket 30 is in a particular rotational orientation relative thereto. Thus, as shown in FIGS. 2 and 3, the aperture 44 is aligned with the detent pin 40 when the bracket 30 (and the collet crimping machine 10 secured thereto) is in its vertically disposed position. When so aligned, the spring 43 urges the tail portion 40*c* of the detent pin 40 into such aperture 44, thereby retaining the bracket 30 in that position. When it is desired to change the position of the bracket 30, the head portion 40*a* of the detent pin 40 is grasped by an operator and pulled against the urging of the spring 43 such that the tail portion 40*c* is withdrawn from the aperture 44. In this manner, the bracket 30 and the collet crimping machine 10 can be freely rotated relative to the support arms 27 and 28. When the detent pin 40 becomes aligned with one of the other apertures 45 and 46, the spring 43 will automatically urge the detent pin 40 into that aperture, thus retaining the collet crimping machine 10** in a new position.

As mentioned above, the aperture 44 is located on the bracket 30 such that the collet crimping machine 10 is retained in its vertically disposed position when the aperture 44 is aligned with the detent pin 40. Similarly, the aperture 45 is located on the bracket 30 such that the collet crimping machine 10 is retained in an intermediate position between the horizontally and vertically disposed positions when the aperture 45 is aligned with the detent pin 40. The aperture 46 is located on the bracket 30 such that the collet crimping machine 10 is retained in its horizontally disposed position when the aperture 46 is aligned with the detent pin 40. It will be appreciated that any number of such apertures 44 through 46 may be provided so as to retain the collet crimping machine 10 in respective discrete orientations relative to the support arms 27 and 28.

Figure 4:
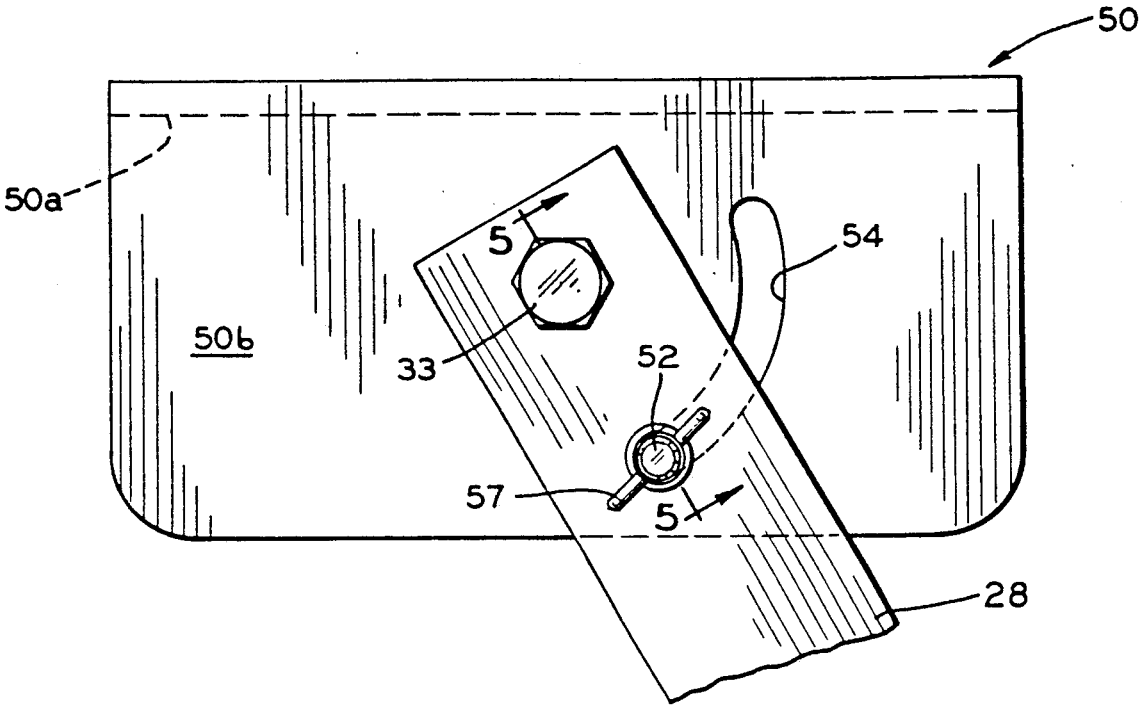
FIG. 4 is an enlarged side elevational view similar to FIG. 2 showing an alternative embodiment of this invention.
Figure 5:
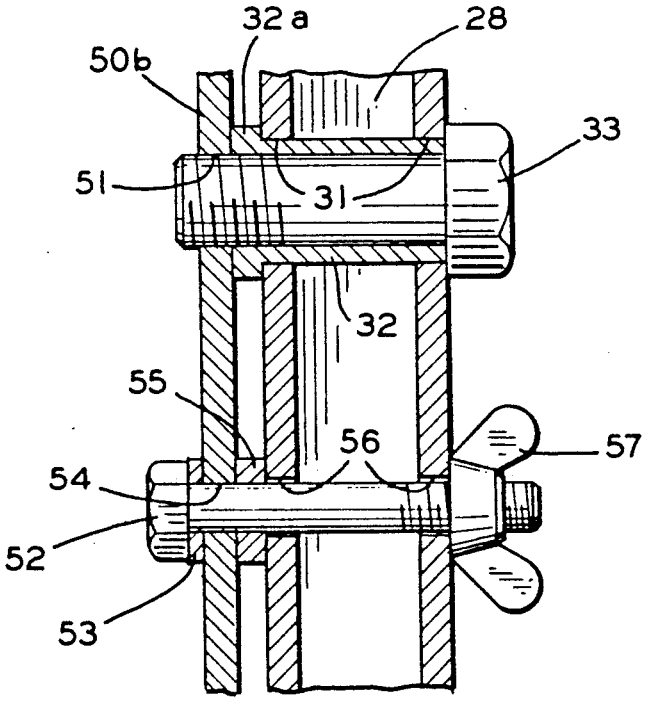
FIG. 5 is a sectional elevational view taken along line 5—5 of FIG. 4.

Referring now to FIGS. 4 and 5, an alternative embodiment of this invention is disclosed. In this embodiment, an L-shaped bracket, indicated generally at 50, is rotatably mounted on the upper end of each of the upper portions of the support arms 27 and 28. Each of the brackets 50 includes a horizontally extending portion 50*a* and a vertically extending portion 50*b*. The horizontally extending portions 50*a* have apertures (not shown) formed therethrough to accommodate threaded fasteners (not shown) which secure the brackets 50 to the upper frame housing 15 of the collet crimping machine 10. As above, a pair of aligned apertures 31 are formed through the sides of the support arm 28. A bushing 32 is pressed into and retained in such apertures 31. The bushing 32 has an enlarged head portion 32*a* which is disposed adjacent to the inner side of the support arm 28, i.e., the side of the support arm 28 which is adjacent to the vertically extending portion 50*b* of the bracket 50. A threaded fastener 33 extends through the bushing 32 and the support arm apertures 31 into threaded engagement with a threaded aperture 51 formed in the vertically extending portion 50*b* of the bracket 50. The threaded fastener 33 supports the bracket 50 (and, thus, the collet crimping machine 10) on the support arm 28. The bushing 32 supports the threaded fastener 33 therein for relative rotation. A similar rotatable mounting structure (not shown) is provided on the upper end of the other support arm 27.

In the embodiment illustrated in FIGS. 4 and 5, the means for selectively retaining the collet crimping machine 10 in a desired rotational position includes a threaded fastener 52. The threaded fastener 52 extends through a lock washer 53, an arcuate slot 54 formed in the vertically extending portion 50*b* of the bracket 50, a spacer 55 disposed between the vertically disposed portion 50*b* of the bracket 50 and the support arm 28, and a pair of aligned apertures 56 formed through the support arm 28 into cooperation with a wing nut 57. By tightening the wing nut 57, the head of the threaded fastener 52 and the vertically extending portion 50*b* of the bracket 50 are drawn toward the support arm 28, compressing the spacer 55 therebetween.

As a result of this compression, friction is generated between the vertically extending portion 50*b* of the bracket 50, the spacer 55, and the support arm 28. This friction prevents the bracket 50 from rotating relative to the support arm 28 until the wing nut 57 is loosened. The lock nut 53 is provided to prevent the threaded fastener 52 from rotating relative to the vertically disposed portion 50*b* of the bracket 50 when the wing nut 57 is tightened. When the wing nut 57 is loosened, the bracket 50 is free to rotate relative to the support arm 28. The threaded fastener 52 travels through the arcuate slot 54 formed through the vertically extending portion 50*b* of the bracket 50 as the bracket 50 rotates. Thus, the positioning of the bracket 50 is not limited to a plurality of discretely defined positions, as with the bracket 30 discussed above. Rather, the bracket 50 may be retained at any one of an infinite number of desired orientations relative to the support arms 27 and 28. The extent of movement of the brackets 50 is limited only by the extent of the slot 54.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. An apparatus for crimping a tubular metallic fitting onto the end of a hose comprising:

a collet crimping machine including a lower frame plate, a die assembly carried on said lower frame plate, and means supported on said lower frame plate for selectively engaging said die assembly so as to crimp a tubular metallic fitting onto the end of a hose, said collet crimping machine defining a center of gravity located on an axis;

a base for rotatably supporting said lower frame plate, die assembly, and engaging means of said collet crimping machine for movement about said axis between first and second positions, said base including a rotatable bracket connected to said collet crimping machine, said bracket having an aperture formed therethrough; and means for selectively retaining said collet crimping machine in a desired rotational position relative to said base, said means for selectively retaining including a detent pin slidably mounted on said base and being movable into cooperation with said bracket aperture to retain said collet crimping machine in a desired rotational position.

2. The invention defined in claim 1 wherein said base includes a support arm connected to said bracket and means for rotatably connecting said bracket to said support arm.

3. The invention defined in claim 2 wherein said detent pin is slidably mounted on said support arm.

4. The invention defined in claim 1 further including means for urging said detent pin into cooperation with said aperture.

5. The invention defined in claim 1 wherein a plurality of apertures are formed through said bracket, said detent pin being slidable into cooperation with each of said apertures to retain said collet crimping machine in a plurality of desired rotational positions.

6. The invention defined in claim 5 further including means for urging said detent pin into cooperation with said apertures.

7. An apparatus for crimping a tubular metallic fitting onto the end of a hose comprising:

a collet crimping machine including a lower frame plate, a die assembly carried on said lower frame plate, and means supported on said lower frame plate for selectively engaging said die assembly so as to crimp a tubular metallic fitting onto the end of a hose, said collet crimping machine defining a center of gravity located on an axis;

a base for rotatably supporting said lower frame plate, die assembly, and engaging means of said collet crimping machine for movement about said axis between first and second positions, said base including a rotatable bracket connected to said collet crimping machine, said bracket having an aperture formed therethrough; and means for selectively retaining said collet crimping machine in an infinite number of desired rotational positions relative to said base within a given range, said means for selectively retaining including means for selectively frictionally engaging said bracket with said base to retain said collet crimping machine in a desired rotational position.

8. The invention defined in claim 7 wherein said means for selectively frictionally engaging includes a slot formed through said bracket and defining the extent of said range of desired rotational positions, a threaded fastener carried on said base and extending through said slot, and means for tightening said threaded fastener so as to draw said bracket into frictional engagement with said base.

9. The invention defined in claim 8 further including a spacer disposed between said bracket and said base, said threaded fastener extending through said spacer, said spacer being compressed between and frictionally engaged by said bracket and said base when said threaded fastener is tightened.

* * * * *